United States Patent [19]

Golda

[11] Patent Number: 4,694,761

[45] Date of Patent: Sep. 22, 1987

[54] YARN CUTTING HEAD

[76] Inventor: Yackob Golda, 5 Noga Street, Herzlia, Israel

[21] Appl. No.: 945,787

[22] Filed: Dec. 23, 1986

[30] Foreign Application Priority Data

Jan. 6, 1986 [IL] Israel ..... 77530

[51] Int. Cl.[4] ..... D05C 15/06

[52] U.S. Cl. ..... 112/80.71; 112/80.08

[58] Field of Search ..... 112/287, 289, 80.71, 112/80.7, 80.04, 80.08

[56] References Cited

U.S. PATENT DOCUMENTS

| | | | |
|---|---|---|---|
| 3,389,667 | 6/1968 | Mueller | 112/80.04 |
| 3,968,758 | 7/1976 | Scholz | 112/80.71 X |
| 4,111,136 | 9/1978 | Spanel et al. | 112/80.71 X |
| 4,119,047 | 10/1978 | Spanel et al. | 112/80.71 X |

*Primary Examiner*—H. Hampton Hunter

*Attorney, Agent, or Firm*—Darby & Darby

[57] ABSTRACT

A yarn cutting head for a tufting machine, including a discoid, rigid cutting plate having a central bore for the free passage therethrough of a first element of the machine, means for rigid attachment of the plate to a second element of the machine, and at least one cutting hole eccentrically located relative to the bore and substantially concentric with a yarn-feeding duct provided in the second member of the machine. The yarn cutting head further includes a revolving cutting knife made of a relatively thin, elastically flexible material, drivable by a motor of the tufting machine via a drive shaft and consisting of a hub portion provided with a hole for connection to the drive shaft, and an elongated cutting portion extending beyond the hub portion. The cutting portion is provided with a cutting edge outwardly extending with respect to the hole and means is provided for pressing at least part of the cutting portion against the cutting plate. The elastically flexible cutting knife is prebent in such a way that when upon assembly, the rear face of the hub portion is pressed against the cutting plate, the elongated cutting portion is pressed against the plate along a relatively narrow strip including the cutting edge.

6 Claims, 7 Drawing Figures

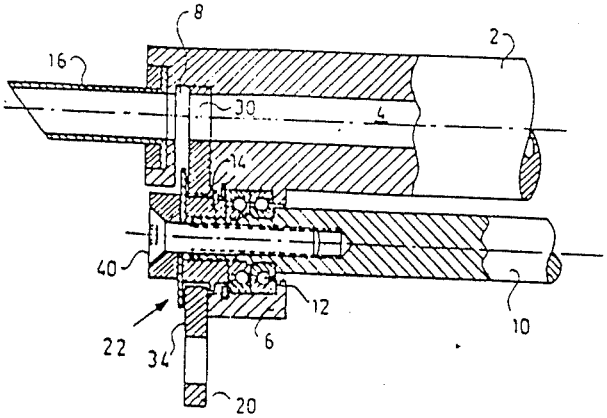
FIG. 1
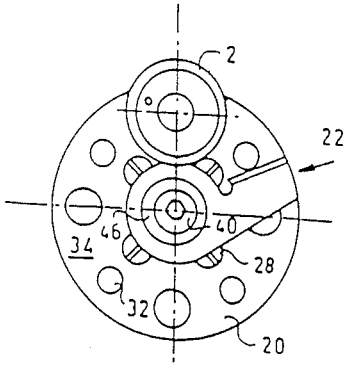
FIG. 2
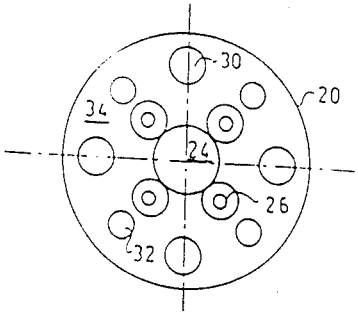
FIG. 3
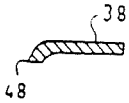
FIG. 5
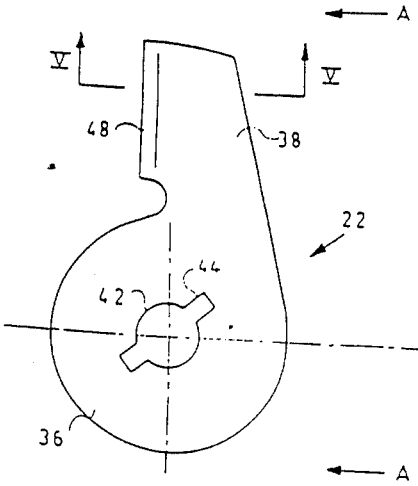
FIG. 4
FIG. 6
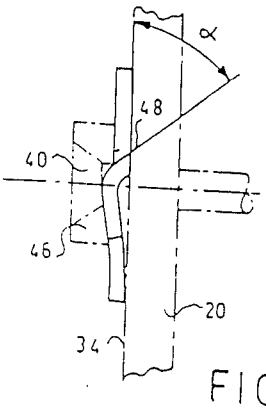
FIG. 7

YARN CUTTING HEAD

The present invention relates to a yarn cutting head for a tufting machine.

In cut-pile tufting, as against loop-pile tufting, the yarn, drawn from a skein or ball, is automatically cut to a predeterminable length in synchronism with the needle stroke, thus forming the pile.

In the past, cutting was performed by a flat, rigid, revolving knife having a cutting edge that, in operation, is moved across the face of an air nozzle through the sharp-edged bore of which the yarn passes, helped along by a flow of air. The air nozzle is slidably mounted in a guide bore and is pressed against the revolving knife by means of a helical spring.

Experience has shown that, due to inevitable wear, enhanced by the vibrations caused by the reciprocating movement of the head, the air nozzle rapidly works itself loose in its guide bore. As soon as this happens, the nozzle face begins to skew. This not only has a blunting effect on the knife edge, but also causes the yarn, instead of being cut, to be wedged between nozzle face and knife surface, resulting in the yarn either tearing or jamming, but in any case causing a break in the smooth tufting operation. Users of the tufting machine have reported that the "downtime" incurred due to the necessary disassembly, cleaning, regrinding and reassembly following such breakdowns may amount to up to 30% of the total working time of the machine, and that expressed in tufted are, the useful life of the knife and nozzle face between regrindings is no more than a few tens of $m^2$ of rug.

It is one of the objects of the present invention to overcome the drawbacks and limitations of the prior-art cutting head, and to provide a cutting plate/cutting knife combination that will effectively prevent wedging of the yarn; that has a self-sharpening effect, in which the yarn duct in the reciprocating member of the machine is freed of the encumbrances constituted by the air nozzle, its housing, the helical spring and the air seal, resulting in unobstructed yarn transport, and in which the cutting knife has a service life of about 200 $m^2$ of rug, and is removed and replaced within seconds, by simply opening a screw and retightening it.

This the invention achieves by providing a yarn cutting head for a tufting machine, comprising:

a discoid, rigid cutting plate having a central bore for the free passage therethrough of a first element of said machine, means for rigid attachment of said plate to a second element of said machine, and at least one cutting hole eccentrically located relative to said bore and substantially concentric, in the attached state of said cutting plate, with yarn-feeding duct provided in said second member of the machine;

a revolving cutting knife made of a relatively thin, elasticallty flexible material, drivable by a motor of said tufting machine via a drive shaft and consisting of a hub portion provided with a hole for connection to said drive shaft, and an elongated cutting portion extending beyond said hub portion, said cutting portion being provided with a cutting edge outwardly extending with respect to said hole, means being provided, in assembly for pressing at least part of said cutting portion against said cutting plate, wherein said elastically flexible cutting knife is prebent in such a way that when upon assembly, the rear face of said hub portion is pressed against said cutting plate said elongated cutting portion is pressed against said plate along a relatively narrow strip only, said strip including said cutting edge.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 1 is a cross-sectional view of the cutting head according to the invention as assembled;

FIG. 2 shows the cutting head as seen from the front;

FIG. 3 is a front view of the cutting plate;

FIG. 4 is an enlarged front view of the cutting knife according to the invention;

FIG. 5 is a partial view, in cross section along plane V—V of FIG. 4 of the cutting portion of the knife;

FIG. 6 is a side view of the knife, as seen in direction of arrows A, illustrating the pre-bent thereof, and FIG. 7 is a top view of the knife, as pressed against the cutting plate.

Referring now to the drawings, there is seen in FIGS. 1 and 2 the cutting head as attached to a tufting machine. Of the latter there are shown a piston-like, reciprocating member 2 with a yarn-feeding duct 4 and a lateral projection 6, a transverse slot 8 close to the front end of the piston-like member 2, a drive shaft 10, powered by the electric motor of the tufting machine and, in a manner to be explained further below, designed to drive the cutting knife according to the invention, a pair of ball bearings 12, accommodatd in the projection 6, in which bearings the stepped-down and threaded front end of the drive shaft 10 is mounted. Further seen is a retaining nut 14 and an interchangeable tufting needle 16.

The cutting head proper is comprised of a stationary cutting plate 20 and a revolving cutting knife 22. The cutting plate 20, seen to best advantage in FIG. 3, is disc-shaped, thick enough to be rigid, and made of a hard of hardenable material such as steel. A central bore 24 accommodates (with clearance) the retaining nut 14, permitting it to rotate (together with drive shaft 10) without friction. Around this central bore 24 there are grouped four holes 26, countersunk to accommodate the heads of screws 28 (FIG. 2) by means of which the cutting plate is fixedly attached to the lateral projectin 6 of the reciprocating member 2 of the tufting machine. As is seen in FIG. 1, the upper part of the plate 20 is introduced into the transverse slot 8 which must be wide enough to accommodate not only plate 20 but must also leave room for the cutting knife 22 in its revolving motion. Further outwardly there are seen four larger holes 30. These are the cutting holes against the sharp edges of which, in a manner to be more fully explained further below, the revolving cutting knife 22 cuts the yarn. Actually, only one hole 30 is needed, namely that hole which registers, or is concentric, with the yarn duct 4, as clearly shown in FIG. 1, the others serving as replacement when the sharp edge of one of the holes 30 has become blunted. The angular relation between the cutting holes 30 and the attachment holes 26 must obviously be such that whenever the plate 20 is attached to the projection 6, one of the cutting holes 30 registers with the yarn duct 4. The smaller holes 32 —of which there could be more than four—serve to reduce the solid mass of the cutting plate 20 and limit temperature rises caused by friction between the plate 20 and the cutting knife 22. At least the front surface 34 of the plate 20 should be ground and the edges produced between the cutting holes 30 and this surface 34 must clearly be sharp. After the edges of all four holde 30 have become blunt, sharpness can easily be restored by regrinding the front surface 34.

The cutting knife 22 illustrated in FIGS. 4 to 7, is made of a relatively thin, elastically flexible, hardened and tempered material such as, e.g. spring steel and consists of a hub portion 36 and as elongated cutting portion 38 extending beyond the hub portion. It is fixedly attached to the drive shaft 10 by means of a screw 40 that passes through a hole 42 in the hub portion 36. Further seen are two drive slots 44 into which fit appropriately dimensioned drive tongues (not shown) that are an integral part of the washer 46 which accommodates the countersunk head of the screw 40.

A cutting edge 48 is produced by bending the outwardly extending edge of the cutting portion 38 downwards, as clearly seen in FIG. 5. The cutting portion 38 is also pre-bent as shown in FIG. 6. When now, in assembly (FIG. 7), the hub section 36 is tightly pressed against the cutting plate 20, the above mentioned prebent will cause the cutting edge 48 along its entire length to be strongly forced against the surface 34, producing favorable conditions for clean cutting of the yarn and precluding wedging. FIG. 7 clearly illustrates the effect of this pre-bend. Seen is also the rake angle alpha which advantageously should be between 50°and 30°.

The material of the cutting knife 22 being selected to be softer than that of the cutting plate 20 (mainly due to tempering), the continuous pressure exerted upon the revolving cuttig edge 48 produces a self-sharpening effect greatly increasing its service life.

When, eventually, the knife 22 has to be removed for regrinding or replacing, this can be done within seconds, by simply unscrewing the screw 40 and removing the washer 46. Attaching a reground or new knife 22 is equally simple.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A yarn cutting head for a tufting machine, comprising:

a discoid, rigid cutting plate having a central bore for the free passage therethrough of a first element of said machine, means for rigid attachment of said plate to a second element of said machine, and at least one cutting hole eccentrically located relative to said bore and substantially concentric, in the attached state of said cutting plate, with a yarn-feeding duct provided in said second member of the machine;

a revolving cutting knife made of a relatively thin, elastically flexible material, drivable by a motor of said tufting machine via a drive shaft and consisting of a hub portion provided with a hole for connection to said drive shaft, and an elongated cutting portion extending beyond said hub portion, said cutting portion being provided with a cutting edge outwardly extending with respect to said hole, means being provided, in assembly for pressing at least part of said cutting portion against said cutting plate, wherein said elastically flexible cutting knife is prebent in such a way that when upon assembly, the rear face of said hub portion is pressed against said cutting plate said elongated cutting portion is pressed against said plate along a relatively narrow strip only, said strip including said cutting edge.

2. The cutting head as claimed in claim 1, wherein said hole in said hub portion includes at least one drive slot engageable by a tongue-like projection of a washer connectable to said drive shaft.

3. The cutting head as claimed in claim 1, wherein said pressure-applying means is a screw passing through said washer and screwable into said drive shaft.

4. The cutting head as claimed in claim 1, wherein said cutting edge has a rake angle of less than 90°.

5. The cutting head as claimed in claim 1, wherein said cutting knife is made of a material softer than the material of said cutting plate.

6. The cutting head as claimed in claim 1, wherein there is provided a plurality of cutting holes.

* * * * *